US011823518B2

(12) United States Patent
Arai et al.

(10) Patent No.: US 11,823,518 B2
(45) Date of Patent: Nov. 21, 2023

(54) INFORMATION PROCESSING DEVICE AND INFORMATION PROCESSING SYSTEM

(71) Applicant: JAPAN CASH MACHINE CO., LTD., Osaka (JP)

(72) Inventors: Hirokazu Arai, Osaka (JP); Toshitaka Nishizaki, Osaka (JP); Masaaki Ichikawa, Osaka (JP)

(73) Assignee: JAPAN CASH MACHINE CO., LTD., Osaka (JP)

( * ) Notice: Subject to any disclaimer, the term of this patent is extended or adjusted under 35 U.S.C. 154(b) by 65 days.

(21) Appl. No.: 17/753,799

(22) PCT Filed: Jun. 24, 2020

(86) PCT No.: PCT/JP2020/024718
§ 371 (c)(1),
(2) Date: Mar. 15, 2022

(87) PCT Pub. No.: WO2021/053918
PCT Pub. Date: Mar. 25, 2021

(65) Prior Publication Data

US 2022/0343714 A1 Oct. 27, 2022

(30) Foreign Application Priority Data

Sep. 19, 2019 (JP) ..... 2019-170258

(51) Int. Cl.
*G07D 11/32* (2019.01)
*G07D 11/16* (2019.01)
(Continued)

(52) U.S. Cl.
CPC ..... *G07D 11/32* (2019.01); *A63F 7/02* (2013.01); *B65H 2553/41* (2013.01); *B65H 2701/1912* (2013.01)

(58) Field of Classification Search
CPC ..... G07D 11/32; A63F 7/02; B65H 2553/41; B65H 2701/1912
See application file for complete search history.

(56) References Cited

U.S. PATENT DOCUMENTS 5,864,735 A * 1/1999 Fukuda ..... G06F 3/1204 271/301
10,324,410 B2 * 6/2019 Mochizuki ..... G03G 15/6508
(Continued)

FOREIGN PATENT DOCUMENTS

JP S61-259685 A 11/1986
JP H05-17049 A 1/1993
(Continued)

OTHER PUBLICATIONS

Banknote Handling Equipment, 19 pages. (Year: 2023).*
(Continued)

*Primary Examiner* — Tuyen K Vo
(74) *Attorney, Agent, or Firm* — MASUVALLEY & PARTNERS; Peter Martinez

(57) ABSTRACT

The present invention reduces the amount of data for generating history information that can identify the time when a paper sheet moves along a transport path. The present invention includes an update unit (103) that updates reference timers (Ta and Tb) at predetermined time intervals (10 μs and 1 ms), respectively, an initializing unit (104) that initializes the reference timers at predetermined time intervals (5 s and 25 s), respectively, a storage unit (102) that stores therein the numbers of times of the initialization, and a saving unit (105) that saves difference information (D) identifying current values of the reference timers and the numbers of times of the initialization when a paper sheet moves along a transport path (P).

6 Claims, 9 Drawing Sheets

(51) Int. Cl.

| | |
|---|---|
| ***G07D 11/20*** | (2019.01) |
| ***G07D 11/237*** | (2019.01) |
| ***A63F 7/02*** | (2006.01) |

(56) References Cited

U.S. PATENT DOCUMENTS

| | | | |
|---|---|---|---|
| 2010/0094462 | A1 | 4/2010 | Sugihara et al. |
| 2010/0217432 | A1 | 8/2010 | Mori |

FOREIGN PATENT DOCUMENTS

| | | | | | |
|---|---|---|---|---|---|
| JP | H11-265472 | A | | 9/1999 | |
| JP | 2002-095843 | A | | 4/2002 | |
| JP | 2005-111003 | A | | 4/2005 | |
| JP | 2005-175614 | A | | 6/2005 | |
| JP | 2008-526536 | A | | 7/2008 | |
| JP | 2009-101171 | A | | 5/2009 | |
| JP | 2010-195514 | A | | 9/2010 | |
| JP | 2011-107980 | A | | 6/2011 | |
| JP | 4939695 | B2 | * | 5/2012 | ..... B65B 27/08 |
| JP | 5156097 | B2 | * | 3/2013 | ..... B65H 31/30 |
| JP | 5198102 | B2 | * | 5/2013 | ..... B65B 27/08 |
| JP | 2015-076805 | A | | 4/2015 | |
| JP | 2015-178393 | A | | 10/2015 | |
| JP | 2016-001449 | A | | 1/2016 | |
| JP | 2017-086236 | A | | 5/2017 | |
| JP | 2018-175712 | A | | 11/2018 | |
| JP | 2018-201762 | A | | 12/2018 | |

OTHER PUBLICATIONS

Banknote Dispensing Device, 10 pages. (Year: 2023).*

Paper Sheet Processing System, 12 pages. (Year: 2023).*

WIPO, Japan Patent Office International Search Authority, International Search Report (with English translation) dated Sep. 8, 2020 in International Patent Application No. PCT/JP2020/024718, 6 pages.

WIPO, Japan Patent Office International Search Authority, Written Opinion dated Sep. 8, 2020 in International Patent Application No. PCT/JP2020/024718, 3 pages.

* cited by examiner

FIG.2(a-1)
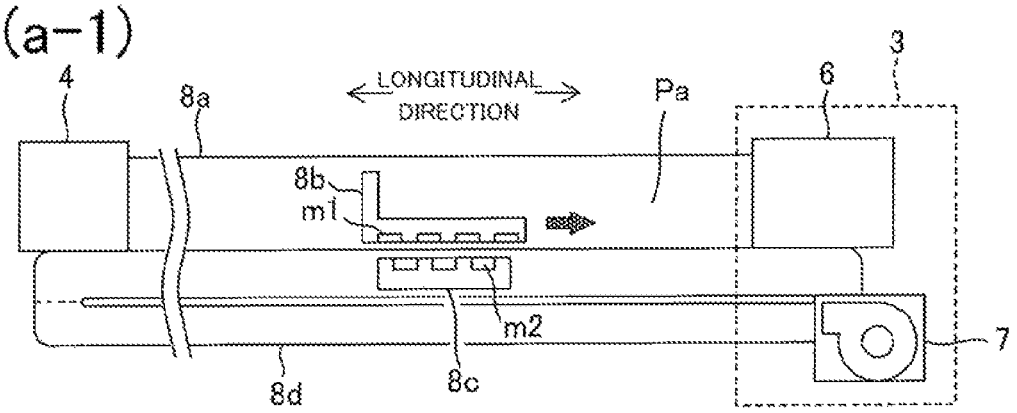
FIG.2(a-2)
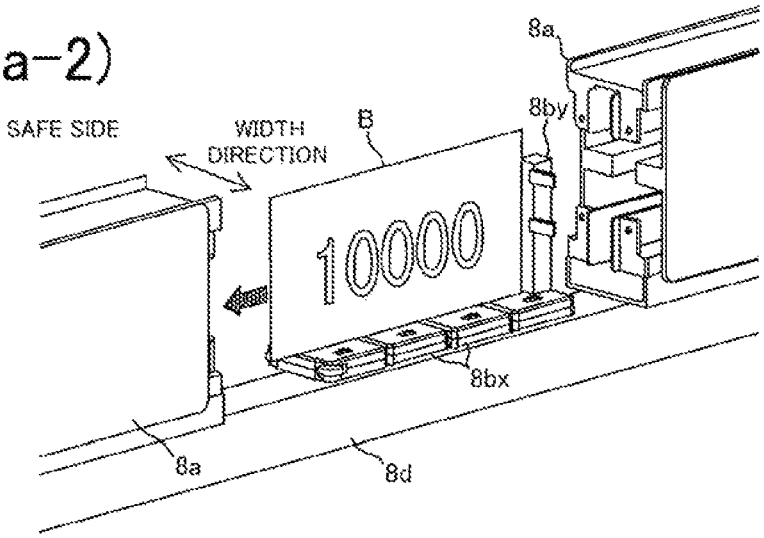
FIG.2(b)
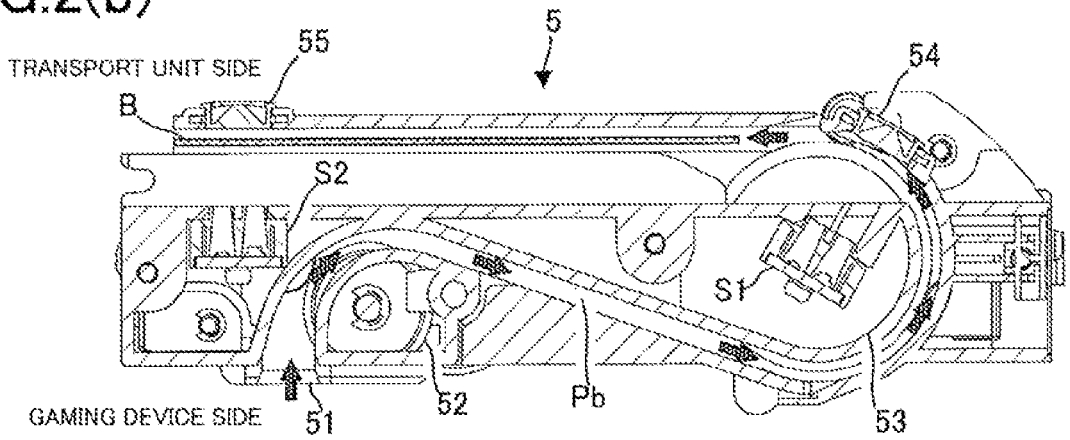

HISTORY INFORMATION J

| TIME | EVENT |
|---|---|
| XX:YY:ZZ | SET REFERENCE TIME |
| XX:YY:ZZ+α1 | SENSOR S1 IS ON |
| XX:YY:ZZ+α2 | SENSOR S2 IS ON |
| XX:YY:ZZ+α3 | SENSOR S1 IS OFF |
| XX:YY:ZZ+α4 | SENSOR S2 IS OFF |
| ⋮ | ⋮ |

FIG.4(a)
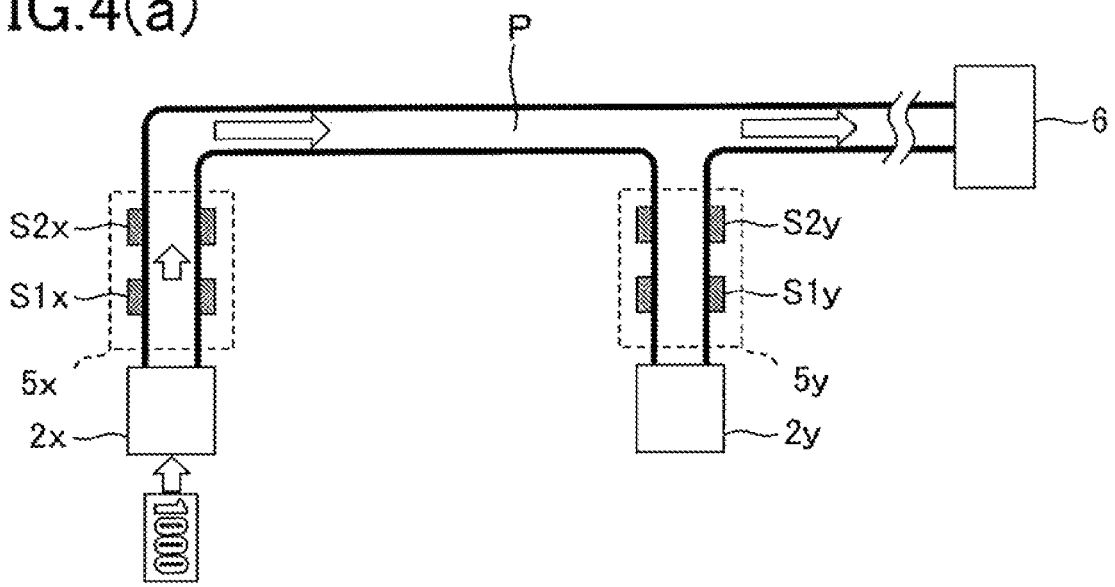
FIG.4(b)
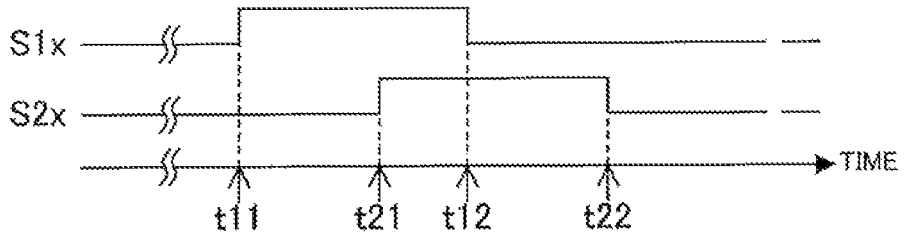
FIG.4(c)
| EVENT | EVENT INFORMATION |
|---|---|
| SENSOR S1x IS ON | E1 |
| SENSOR S2x IS ON | E2 |
| SENSOR S1x IS OFF | E3 |
| SENSOR S2x IS OFF | E4 |
| SENSOR S1y IS ON | E5 |
| SENSOR S2y IS ON | E6 |
| SENSOR S1y IS OFF | E7 |
| SENSOR S2y IS OFF | E8 |

FIG.5(a)
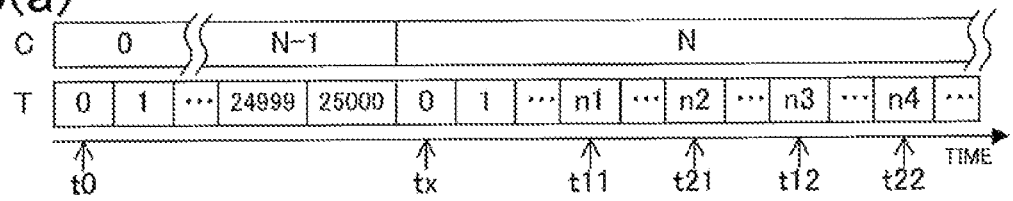
FIG.5(b)
| TIME POINT | EVENT (EVENT INFORMATION E) | T | C | D | ELAPSED TIME (ms) |
|---|---|---|---|---|---|
| t0 | SET REFERENCE TIME | 0 | 0 | – | 0 |
| ⋮ | ⋮ | ⋮ | ⋮ | ⋮ | ⋮ |
| tx | RECEIVE NTH COMMAND X | 0 | N | – | 25000 × N |
| ⋮ | ⋮ | ⋮ | ⋮ | ⋮ | ⋮ |
| t11 | SENSOR S1x IS ON (E1) | n1 | N | D1 | (25000 × N) + (n1) |
| t21 | SENSOR S2x IS ON (E2) | n2 | N | D2 | (25000 × N) + (n2) |
| t12 | SENSOR S1x IS OFF (E3) | n3 | N | D3 | (25000 × N) + (n3) |
| t22 | SENSOR S2x IS OFF (E4) | n4 | N | D4 | (25000 × N) + (n4) |
FIG.5(c-1)
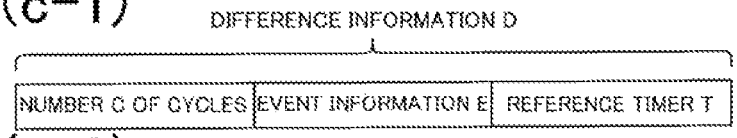
FIG.5(c-2)
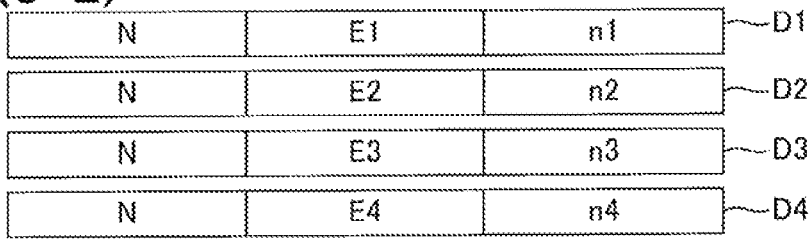

FIG.8(a)

| EVENT | EVENT INFORMATION |
|---|---|
| SENSOR Sa1 IS ON | E11 |
| SENSOR Sa2 IS ON | E12 |
| SENSOR Sa1 IS OFF | E13 |
| SENSOR Sa2 IS OFF | E14 |

| EVENT | EVENT INFORMATION |
|---|---|
| SENSOR Sb1 IS ON | E15 |
| SENSOR Sb2 IS ON | E16 |
| SENSOR Sb1 IS OFF | E17 |
| SENSOR Sb2 IS OFF | E18 |

FIG.8(b)

| | UPDATE MOMENT | INITIALIZATION MOMENT |
|---|---|---|
| REFERENCE TIMER Ta | ABOUT EVERY 10 μs | ABOUT EVERY 5 s |
| NUMBER Ca OF CYCLES | EACH TIME Ta IS INITIALIZED | – |
| REFERENCE TIMER Tb | ABOUT EVERY 1 ms | ABOUT EVERY 25 s |
| NUMBER Cb OF CYCLES | EACH TIME Tb IS INITIALIZED | – |

FIG.8(c)

| NUMBER Ca OF CYCLES | EVENT INFORMATION E11 to 14 | REFERENCE TIMER Ta | Da |
|---|---|---|---|

ELAPSED TIME (ms)=5000 × Ca+Ta × (1/100)

| NUMBER Cb OF CYCLES | EVENT INFORMATION E15 to 18 | REFERENCE TIMER Tb | Db |
|---|---|---|---|

ELAPSED TIME (ms)=25000 × Cb+Tb

FIG.9(b-1)

RESET Ta AND Tb

| | dp1 | dp2 | | |
|---|---|---|---|---|
| ··· | CURRENT VALUE OF Ca | CURRENT VALUE OF Cb | ··· | X1 |

FIG.9(b-2)

RESET Ta

| | dp1 | dp2 | | |
|---|---|---|---|---|
| ··· | CURRENT VALUE OF Ca | 0 | ··· | X2 |

INFORMATION PROCESSING DEVICE AND INFORMATION PROCESSING SYSTEM

RELATED APPLICATIONS

This application is the U.S. National Phase of and claims priority to International Patent Application No. PCT/JP2020/024718, International Filing Date Jun. 24, 2020, entitled *Information Processing Device And Information Processing System*; which claims benefit of Japanese Provisional Application Serial No. 2019-170258 filed Sep. 19, 2019 entitled *Information Processing Device And Information Processing System*; and both of which are incorporated herein by reference in their entireties.

FIELD

The present invention relates to an information processing device and an information processing system.

BACKGROUND

Various techniques to transport paper sheets (for example, banknotes) are conventionally proposed. For example, Patent Literature 1 discloses a technique to transport banknotes that are input to gaming devices in a game hall and house the banknotes in a safe. A configuration (for example, various sensors) that enables detection of a banknote on a transport path is adopted in these conventional techniques.

There are also cases of adopting a configuration that includes a counter (hereinafter, "time counter") indicating the current time and stores the current value of the time counter when a paper sheet is detected. In the configuration described above, history information that can identify the time when a paper sheet is detected can be generated.

CITATION LIST

Patent Literature

Patent Literature 1: Japanese Patent Application Laid-open No. 2009-101171

SUMMARY

Technical Problem

However, when the data length of the time counter is long, inconvenience that the amount of data for generating the history information described above becomes too large is likely to arise. In view of the circumstances described above, the present invention has an object to reduce the amount of data for generating history information.

Solution to Problem

In order to solve the above problems, an information processing device according to the present invention comprises an update unit that updates a reference timer at predetermined time intervals, an initializing unit that initializes the reference timer at predetermined time intervals, a storage unit that stores therein number of times of the initialization, and a saving unit that saves difference information identifying a current value of the reference timer and the number of times of the initialization when a paper sheet moves along a transport path.

In the above configuration, the current value of the reference timer and the number of times of initialization of the reference timer are identified by difference information. When the time interval at which the reference timer is updated is "X", the current value of the reference timer is "Y", the time interval at which the reference timer is initialized is "Z", and the number of times of initialization of the reference timer is "W", the elapsed time from a specific time point (a time point where W=0 and Y=0) is calculated by "X×Y+Z×W". Therefore, a time when a banknote moved along the transport path is recognized from the difference information. Furthermore, in the present invention, the amount of data for generating history information can be reduced relative to a configuration in which the current value of the time counter is accumulated and saved, for example, each time a banknote moves along the transport path.

Advantageous Effects of Invention

According to the present invention, it is possible to reduce the amount of data for generating history information that can identify the time when a paper sheet is detected on a transport path.

BRIEF DESCRIPTION OF DRAWINGS

FIG. 2 are explanatory diagrams of constituent parts of the information processing system.

FIG. 4 are explanatory diagrams of a transport path for banknotes.

FIG. 5 are explanatory diagrams of a specific example of difference information in a first embodiment.

FIG. 8 are explanatory diagrams of a specific example of difference information in a second embodiment.

DESCRIPTION OF EMBODIMENTS

First Embodiment

Figure 1A:
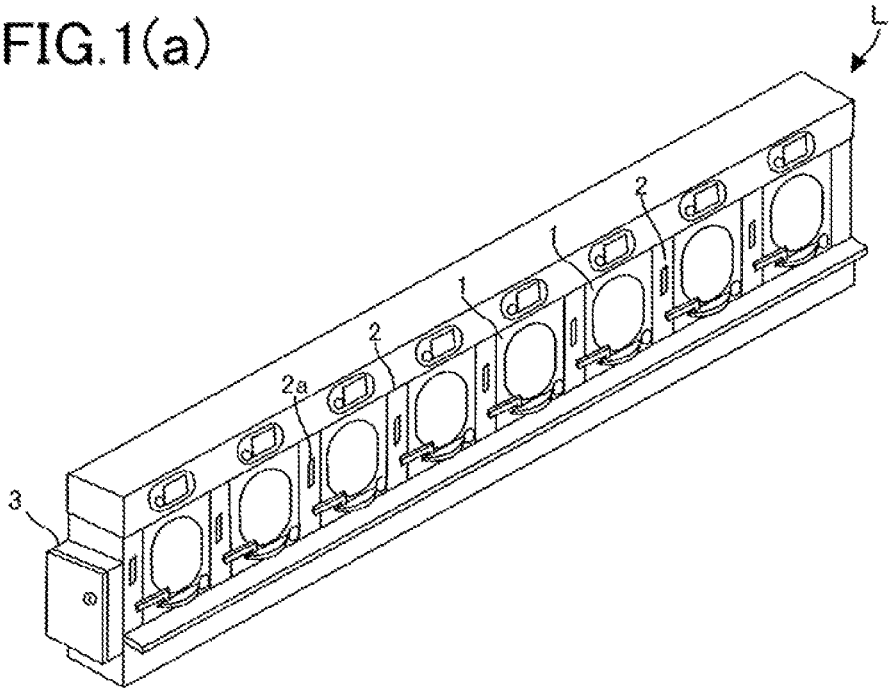
FIG. 1 are explanatory diagrams of a specific example of a game hall in which an information processing system is adopted.
Figure 1B:
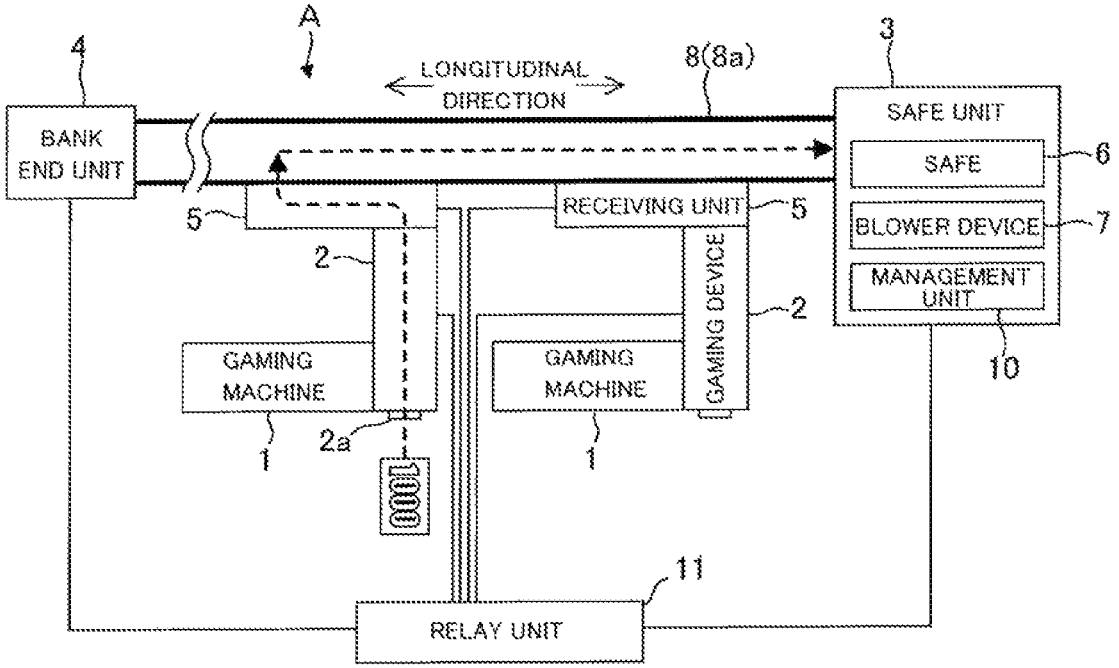

FIG. 1(*a*) is an explanatory diagram of an example of a game hall in which an information processing system (an information processing device) of the present invention is adopted. FIG. 1(*a*) illustrates some of a plurality of gaming machines 1 installed in the game hall. As illustrated in FIG. 1, the gaming machines 1 are installed to be grouped into banks L. In the specific example of FIG. 1(*a*), eight gaming machines 1 are installed on one bank L. In the specific example of FIG. 1(*a*), the gaming machines 1 (pachinko machines) that can be played with game balls are illustrated as an example.

As illustrated in FIG. 1(*a*), gaming devices 2 are installed in the game hall. In the present embodiment, one of the gaming devices 2 is provided with respect to each of the gaming machines 1. In the specific example of FIG. 1(*a*), the gaming devices 2 are provided to be adjacent on the left side to the gaming machines 1 handled by the corresponding gaming devices 2, respectively. A banknote inlet 2*a* is provided for each of the gaming devices 2. When a banknote (a paper sheet) is input to the banknote inlet 2*a*, the corresponding gaming device 2 is enabled to rent out game balls.

As illustrated in FIG. 1(*a*), a safe unit 3 is provided on one end (an end plate) of each of the banks L. Banknotes input to the gaming devices 2 (the banknote inlets 2*a*) are housed in the safe unit 3 (a safe 6 described later) through a transport path (see FIG. 1(*b*) described later) inside the bank L. The safe unit 3 of the present embodiment houses banknotes from all the gaming devices 2 provided on each of the banks L.

The present embodiment assumes a configuration in which one safe unit 3 is provided for one bank L. However, a configuration in which one safe unit 3 is provided for a plurality of banks L may be applied. The safe unit 3 can house banknotes transported from the gaming devices 2 of the banks L.

FIG. 1(*b*) is an explanatory diagram of constituent parts of an information processing system A. As illustrated in FIG. 1(*b*), the information processing system A includes a bank end unit 4, receiving units 5, and a relay unit 11 (an information processing device) in addition to the safe unit 3 described above. The bank end unit 4, the receiving units 5, and the relay unit 11 are provided, for example, inside the bank L.

As illustrated in FIG. 1(*b*), the safe unit 3 and the relay unit 11 are communicably connected to each other. The relay unit 11 is communicably connected to the gaming devices 2, the bank end unit 4, and the receiving units 5. The safe unit 3 is communicable with other devices via the relay unit 11. However, a configuration in which the safe unit 3 can (directly) communicate with other devices without using the relay unit 11 may be applied. The constituent parts of the information processing system A can be appropriately changed. For example, a configuration in which one receiving unit 5, or three or more receiving units 5 are connected to the relay unit 11 may be applied.

In FIG. 1(*b*), an example of a transport path along which a banknote has actually moved in a transport path from one of the gaming devices 2 to the safe unit 3 is indicated by a broken arrow. Specifically, a banknote input through the banknote inlet 2*a* of the gaming device 2 passes through the inner part of the gaming device 2 and is discharged from the back surface of the gaming device 2 to the inner part of the corresponding bank L. The banknote discharged from the gaming device 2 is received by the corresponding receiving unit 5 (see FIG. 2(*b*) described later).

Each of the receiving units 5 can temporarily retain a banknote received from the corresponding gaming device 2. The receiving units 5 of the present embodiment are configured to be capable of retaining a plurality of banknotes. However, the receiving units 5 may have a configuration that cannot retain a banknote (that is, the banknote only passes therethrough). When a collection command is transmitted from the safe unit 3, a retained state (escrow) is canceled and the banknotes retained in each of the receiving units 5 become capable of moving inside a transport unit 8.

The transport unit 8 transports banknotes from the receiving units 5 to the safe unit 3. While described in detail later, the transport unit 8 of the present embodiment transports banknotes using an air flow and a magnetic force. However, the method of transporting banknotes in the transport unit 8 is not limited to that using the air flow. For example, a configuration in which banknotes are transported by a transport belt (for example, a configuration described in Japanese Patent Application Laid-open No. 2008-114977) may be adopted.

As illustrated in FIG. 1(*b*), the transport unit 8 is configured to include a transport tube 8*a* extending in the longitudinal direction of the bank L (the array direction of the gaming machine 1) (see FIG. 2(*a*-1) described later). In the present embodiment, banknotes are transported inside the transport tube 8*a*. The transport tube 8*a* extends along the longitudinal direction of the bank L.

The safe unit 3 is configured to include the safe 6, a blower device 7, and a management unit 10. The safe 6 receives banknotes transported by the transport unit 8 and retains the banknotes therein. The safe 6 is configured to be lockable and is unlocked with, for example, a key carried by the administrator of the game hall. The administrator of the game hall periodically collects the banknotes retained in the safe 6. The blower device 7 generates air flow for transporting banknotes in the transport unit 8 described above.

The management unit 10 transmits various commands to the relay unit 11. For example, the management unit 10 transmits the collection command described above to the relay unit 11. The collection command includes information identifying any of the receiving units 5. When the collection command is transmitted, the banknotes retained in the relevant receiving unit 5 are enabled to move to the safe 6 through the transport unit 8.

The management unit 10 also transmits an identification command to the relay unit 11. While described in detail later, a configuration (sensors S described later) that enables detection of a banknote on the transport path (the receiving units 5) is included and difference information D that can identify a time when the banknote has been detected is generated in the present embodiment. A reference timer T is provided in the relay unit 11 and the difference information D described above includes a value of the reference timer T at a time point when a banknote has been detected. The relay unit 11 initializes the reference timer T when receiving the identification command.

As illustrated in FIG. 1(*b*), the bank end unit 4 is provided at one of ends of the transport unit 8 on the opposite side to the safe unit 3. While described in detail with reference to FIGS. 2(*a*-1) and 2(*a*-2), the transport unit 8 is configured to include a transport body 8*b* and a moving body 8*c*. Due to movement of the transport body 8*b* and the moving body 8*c*, banknotes move along the transport path (the transport tube 8*a*) of the transport unit 8. The bank end unit 4 detects and controls the locations of the transport body 8*b* and the moving body 8*c*.

FIGS. 2(*a*-1) and 2(*a*-2) are diagrams for explaining details of the transport unit 8. FIG. 2(*a*-1) is a diagram of the transport unit 8 seen in the width direction (a direction perpendicular to the longitudinal direction). As illustrated in FIG. 2(*a*-1), the transport unit 8 is configured to include the transport tube 8*a*, the transport body 8*b*, the moving body 8*c*, and an air blowing tube 8*d*.

The air blowing tube 8*d* forms a flow path of a gas. The air flow in the air blowing tube 8*d* is controlled by the blower device 7 described above. The moving body 8*c* is provided inside the air blowing tube 8*d* as illustrated in FIG. 2(*a*-1). The moving body 8*c* travels (moves) inside the air blowing tube 8*d* due to the air flow in the air blowing tube 8*d*.

The transport unit 8 includes the transport tube 8*a* arranged adjacently to the air blowing tube 8*d* with at least a part thereof along the air blowing tube 8*d*. The transport body 8*b* traveling (moving) in the transport tube 8*a* is provided inside the transport tube 8*a*. The transport body 8*b* is configured to be movable in the transport tube 8*a* while holding banknotes (see FIG. 2(*a*-2) described later).

In FIG. 2(*a*-1), the transport body 8*b* in the transport tube 8*a* is illustrated for sake of explanations. That is, FIG. 2(*a*-1) illustrates a specific example in a case where the transport tube 8*a* is assumed to be transparent. FIG. 2(*a*-1) similarly illustrates the moving body 8*c* in the air blowing tube 8*d* for sake of explanations. That is, FIG. 2(*a*-1) illustrates a specific example in a case where the air blowing tube 8*d* is assumed to be transparent.

As illustrated in FIG. 2(*a*-1), the moving body 8*c* includes moving body magnets m2 and the transport body 8*b* includes transport body magnets m1. The transport unit 8 of the present embodiment moves the transport body 8*b* with a magnetic force acting on the moving body 8*c* when the moving body 8*c* is moved in the longitudinal direction of the air blowing tube 8*d* due to the air flow in the air blowing tube 8*d*. That is, the transport unit 8 moves the transport body 8*b* in conjunction with movement of the moving body 8*c* receiving the air flow, due to attraction and/or repulsion based on the magnetic force acting between the transport body magnets m1 and the moving body magnets m2.

The transport tube 8*a* is formed of a material that does not affect travel of the transport body 8*b* based on the magnetic force. Specifically, it is preferable that the whole transport tube 8*a* be formed of a non-magnetic material. However, the transport tube 8*a* may include a magnetic material in a portion within a range that does not affect travel of the transport body 8*b*.

FIG. 2(*a*-2) is a perspective view illustrating a relation between the transport tube 8*a* and the transport body 8*b*. In FIG. 2(*a*-2), a state in which the inner part of the transport tube 8*a* is partially exposed is illustrated. As illustrated in FIG. 2(*a*-2), the transport body 8*b* includes a transport base 8*bx* that is arranged on a side nearer the air blowing tube 8*d* and that is subjected to the magnetic force from the moving body 8*c*, and a banknote holding part 8*by* that is provided on the opposite side of the transport base 8*bx* to the air blowing tube 8*d*. The banknote holding part 8*by* holds the banknotes retained in the receiving units 5 described above.

The banknotes held by the banknote holding part 8*by* are housed in the safe 6 after the transport body 8*b* moves to the safe unit 3. Hereinafter, the transport path of banknotes in the transport unit 8 is also referred to as "transport path Pa" for sake of explanations. The banknotes can be transported at a speed of about 5 m/s along the transport path Pa of the present embodiment. The transport path Pa in the transport unit 8 is indicated by an arrow in FIGS. 2(*a*-1) and 2(*a*-2).

FIG. 2(*b*) is an explanatory diagram of a transport path for banknotes in each of the receiving units 5. Hereinafter, the transport path for banknotes in each of the receiving units 5 is also referred to as "transport path Pb" for sake of explanations. The transport path Pa described above and the transport path Pb are also collectively referred to as "transport path P".

FIG. 2(*b*) is a sectional view of the receiving unit 5 taken in the horizontal direction. The transport path Pb is indicated by arrows in FIG. 2(*b*). A banknote B on the transport path Pb is illustrated as an example in FIG. 2(*b*). As illustrated in FIG. 2(*b*), the receiving unit 5 is configured to include a receiving port 51, drive rollers (52 and 53), sensing prisms (54 and 55), and sensors S (S1 and S2). However, the configuration of the receiving unit 5 can be appropriately changed.

The receiving port 51 receives a banknote from the corresponding gaming device 2. Specifically, a discharge port from which a banknote input through the inlet 2*a* (see FIG. 1) of the gaming device 2 is discharged is provided on the back side of the gaming device 2. The receiving unit 5 is provided at a location where the discharge port of the gaming device 2 and the receiving port 51 are communicated with each other, and the banknote discharged from the discharge port of the gaming device 2 can directly enter the receiving port 51. The banknote having entered the receiving port 51 moves along the transport path Pb due to the driving roller 52 and the driving roller 53.

The sensors S are sensors for detecting a banknote on the transport path Pb. In the present embodiment, a photosensor including a light emitting element and a light receiving element is adopted as each of the sensors S. However, sensors other than the photosensor may be used as the sensors S.

When there is no banknote on the transport path Pb, detection light emitted from the light emitting elements of the sensors S reflects from the corresponding sensing prisms (54 and 55) and enters the light receiving elements of the sensors S. On the other hand, when a banknote is moving along the transport path Pb and the detection light emitted from the light emitting elements of the sensors S is blocked by the banknote, the detection light does not enter the light receiving elements of the sensors S.

For sake of explanations, a state in which detection light does not enter the light receiving element of each of the sensors S (a state in which a banknote is detected) is hereinafter also referred to as "ON state" of the sensor S. A state in which detection light enters the light receiving element of each of the sensors S (a state in which no banknote is detected) is also referred to as "OFF state" of the sensor S. A detection signal indicating the state (the ON state or the OFF state) of the relevant sensor S is input from the sensor S to a relay device 100 (an information processing device, see FIG. 3(*a*) described later). A configuration in which a command indicating the state of each of the sensors S is periodically transmitted from the relay unit 11 to the management unit 10 may be applied.

As illustrated in FIG. 2(*b*), the sensors S include the sensor S1 and the sensor S2. The sensor S1 detects a banknote moving on an upstream side of the transport path Pb from the sensor S2. In this configuration, when a banknote moves along the transport path Pb, the sensor S1 and the sensor S2 are brought to an ON state in this order. However, the number of the sensors S provided in the receiving unit 5 is not limited to two. For example, three or more sensors S may be provided in the receiving unit 5, or one sensor S may be provided therein.

As is understood from the above explanations, a banknote moving along the transport path Pb is detected by the sensors S in the configuration of the present embodiment. While explained in detail below, information (difference information D described later) that identifies a time (history) when a banknote is detected on the transport path P is generated in the information processing system A of the present embodiment. A configuration in which a banknote is detected on the transport path Pa (the transport unit 8) may be applied. A specific example of this configuration will be explained in a second embodiment described later (see FIG. 7 described later).

Figures 3A, 3B:
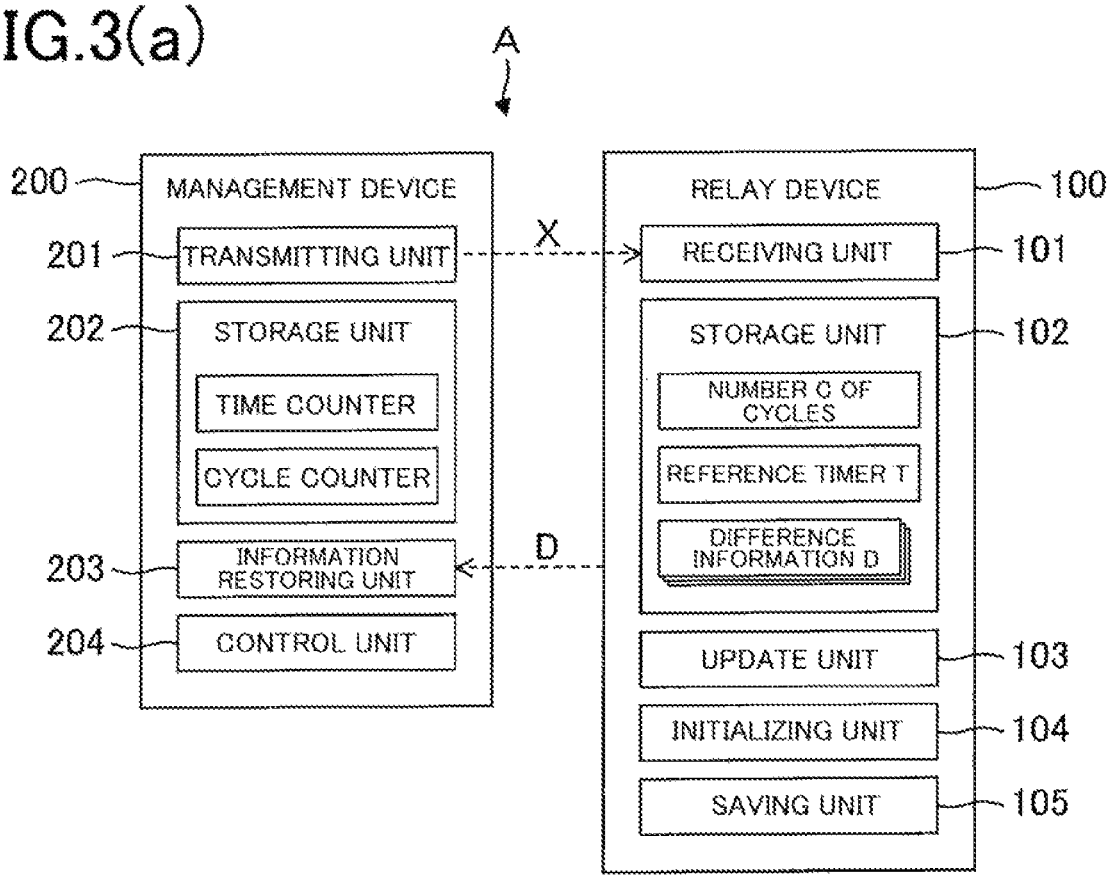
FIG. 3 are functional block diagrams of the information processing system.

FIG. 3(*a*) is a functional block diagram of the information processing system A of the present embodiment. As illustrated in FIG. 3(*a*), the information processing system A is configured to include the relay device 100 and a management device 200. For example, a CPU (Central Processing Unit) of the relay unit 11 described above functions as the relay device 100 by executing a program stored in a ROM (Read Only Memory). A CPU of the management unit 10 described above functions as the management device 200 by executing a program.

As illustrated in FIG. 3(*a*), the management device 200 includes a transmitting unit 201, a storage unit 202, an information restoring unit 203, and a control unit 204. The transmitting unit 201 transmits the various commands (the collection command and the identification command) described above. For sake of explanations, the identification command among the commands described above is hereinafter referred to as "identification command X" (which is simply denoted by "X" in FIG. 3(*a*)).

The identification command X is a command for initializing the reference timer T of the relay device 100 (the relay unit 11) as described above. The transmitting unit 201 transmits the identification command X to the relay device 100 at predetermined time intervals. Specifically, the transmitting unit 201 transmits the identification command X about every 25 s (seconds). This configuration is restated as that the reference timer T of the relay device 100 is initialized about every 25 s.

The storage unit 202 of the management device 200 stores therein various types of information for controlling the information processing system A. For example, a time counter and a cycle counter are provided in the storage unit 202 as illustrated in FIG. 3(*a*). The time counter stores therein the current time (hours, minutes, and seconds). For example, when the information processing system A (the management device 200) is powered ON, the current time is stored as an initial value of the time counter. The initial value of the time counter is also stored as a reference time in the management device 200.

The cycle counter of the storage unit 202 is incremented by a value "1" each time the identification command X is transmitted. The cycle counter is initialized at a time when the reference time is set. The number of times of transmission of the identification command X from the reference time is stored in the cycle counter.

As described above, when the identification command X is transmitted, the reference timer T is initialized. Therefore, the cycle counter described above is restated as storing the number of times of initialization of the reference timer T. The identification command X includes a current value (a value immediately after update) of the cycle counter. In this configuration, the relay device 100 is notified of the current value of the cycle counter by the identification command X.

The information restoring unit 203 generates history information J. The history information J is information that can identify a time when the state (an ON state or an OFF state) of each of the sensors S (see FIG. 2(*b*) described above) on the transport path P for banknotes has changed. While described in detail later, the information restoring unit 203 acquires difference information D (see FIG. 5 described later) from the relay device 100 at predetermined moments and generates the history information J from the difference information D.

FIG. 3(*b*) is an explanatory diagram of a specific example of the history information J. As illustrated in FIG. 3(*b*), the history information J is configured to include specific events (changes of the state of each of the sensors S) and times when these events have occurred. For example, the specific example illustrated in FIG. 3(*b*) assumes a case in which the sensor S1 has changed to an ON state at a time "XX (hours):YY (minutes):ZZ (seconds)+α1 seconds", the sensor S2 has changed to an ON state at a time "XX:YY:ZZ+α2 seconds", the sensor S1 has changed to an OFF state at a time "XX:YY:ZZ+α3 seconds", and the sensor S2 has changed to an OFF state at a time "XX:YY:ZZ+α4 seconds".

The time counter of the present embodiment is incremented about every 10 μs. The time counter has such a magnitude of data that does not produce a carry (that can be continuously updated) even when it is continuously updated for X hours (X is a positive integer). With this configuration, the history information J during a period (hereinafter, also "history recording period") for X hours can be generated. For example, 24 hours (one day) are supposed as one history recording period.

Referring back to FIG. 3(*a*), the control unit 204 of the management device 200 executes various types of control. For example, the control unit 204 controls the banknotes retained in the receiving units 5 described above to be movable along the transport path 8*a*. The control unit 204 also executes control for displaying the history information J described above on a prescribed display device. Furthermore, the control unit 204 controls communication with a hall computer (a device of a higher order than the management device).

As illustrated in FIG. 3(*a*), the relay device 100 is configured to include a receiving unit 101, a storage unit 102, an update unit 103, an initializing unit 104, and a saving unit 105. The receiving unit 101 receives the identification command X transmitted by the management device 200 (the transmitting unit 201) described above.

The storage unit 102 of the relay device 100 stores therein the number C of cycles, the reference timer T, and the difference information D as illustrated in FIG. 3(*a*). The number C of cycles indicates the current value of the cycle counter in the management device 200 (the storage unit 202) described above. As described above, the identification command X includes the current value of the cycle counter. When the identification command X is received, the relay device 100 updates the number C of cycles with the current value of the cycle counter included in the identification command X.

The configuration in which the number C of cycles is overwritten with the current value of the cycle counter included in the identification command X may be replaced with a configuration in which a value "1" is added to the number C of cycles in the storage unit 102 each time the identification command X is received. While described in detail later, the number C of cycles is used to generate the difference information D.

The update unit 103 updates the reference timer T at predetermined time intervals. Specifically, the update unit 103 adds a value "1" to the reference timer T about every 1 ms. The time interval at which the reference timer T is updated needs to be appropriately set. For example, the time interval at which the reference timer T is updated needs to be set according to the banknote transport speed. This configuration will be explained in detail in the second embodiment described later.

The initializing unit 104 initializes the reference timer T at predetermined time intervals. Specifically, as described above, the reference timer T is initialized when the identification command X is received. The identification command X is received about every 25 s. Therefore, the reference timer T is initialized about every 25 s. While described in detail later, the reference timer T is used to generate the difference information D.

The saving unit 105 saves the difference information D when a banknote is detected on the transport path of each of the receiving units 5. The difference information D includes the current value of the reference timer T and the number C of cycles (the number of times of initialization of the reference timer T) at a time point when a banknote is detected. The difference information D of the present embodiment includes event information E (see FIG. 4(*c*) described later) in addition to the reference timer T and the number C of cycles. The event information E is information that can identify the type of the sensor S having detected a banknote.

The difference information D is stored in the storage unit 102 each time a banknote is detected on the transport path. The relay device 100 transmits the difference information D stored in the storage unit 102 to the management device 200 at predetermined moments. For example, a configuration is supposed in which an instruction to transmit the difference information D to the relay device 100 is transmitted when the management device 200 is appropriately operated. In this configuration, the difference information D is transmitted from the relay device 100 to the management device 200 when the instruction described above is received by the relay device 100.

The management device 200 (the information restoring unit 203) generates the history information J (see FIG. 3(*b*) described above) using the difference information D received from the relay device 100 as described above. The moments when the difference information D is to be transmitted from the relay device 100 to the management device 200 can be appropriately changed. For example, a configuration in which the difference information D is automatically transmitted to the management device 200 at moments when the relay device 100 is powered OFF is conceivable.

The history information J includes the matter (an event) of the state change of each of the sensors S and the occurrence time of the state change as described above. Therefore, the configuration of the present embodiment (the configuration to generate the history information J from the difference information D) may be replaced with a configuration (hereinafter, "comparative example)" in which the time counter described above is provided in the relay device 100. In this comparative example, values of the time counter at time points when each of the sensors S has changed in the state are accumulated in the relay device 100 and the history information J is generated from the accumulated values of the time counter.

However, the data length of the time counter needs to be long depending on the history recording period. For example, when the history recording period is 24 hours, the time counter needs to have a data length that does not produce a carry even when continuously incremented for 24 hours. Therefore, when the history recording period is prolonged, inconvenience that the amount of data to be stored in the relay device 100 to generate the history information J becomes too large may arise in the above comparative example in which the current values of the time counter are accumulated.

The difference information D (the number C of cycles, the reference timer T, and the event information E) of the present embodiment does not include the current value of the time counter. The management device 200 can calculate the time when each of the sensors S has detected a banknote from the number C of cycles and the reference timer T in the difference information D. Therefore, the present embodiment has an advantage that the amount of data for generating the history information J can be reduced, for example, relative to the comparative example described above. This configuration is explained in detail below.

FIG. 4(*a*) is an explanatory diagram of details of the transport path P in the present embodiment and the sensors S that detect a banknote moving along the transport path P. The relay device 100 (the relay unit 11) of the present embodiment is connected to a plurality of (two) receiving units 5. Hereinafter, for sake of explanations, one of the receiving units 5 is referred to also as a receiving unit 5*x* and the other is referred to also as a receiving unit 5*y*. As illustrated in FIG. 4(*a*), the receiving unit 5*x* receives banknotes from a gaming device 2*x*. The receiving unit 5*y* receives banknotes from a gaming device 2*y*.

As described above, the receiving units 5 each include the sensor S1 and the sensor S2 that detect a banknote on the transport path P. Hereinafter, for sake of explanations, the sensor S1 of the receiving unit 5*x* is referred to as "sensor S1*x*" and the sensor S2 thereof is referred to as "sensor S2*x*". Similarly, the sensor S1 of the receiving unit 5*y* is referred to as "sensor Sly" and the sensor S2 thereof is referred to as "sensor S2*y*". The shape of the transport path P and the location relation of the sensors illustrated in FIG. 4(*a*) are different from actual ones.

FIG. 4(*b*) is an explanatory diagram of a specific example of the state changes of the sensors S. In the specific example of FIG. 4(*b*), a case in which a banknote is input to the gaming device 2*x* in the specific example of FIG. 4(*a*) described above is assumed. In this case, the banknote is transported from the gaming device 2*x* to the receiving unit 5*x*.

In the specific example of FIG. 4(*b*), the banknote is detected by the sensor S1*x* and the sensor S2*x* in the receiving unit 5*x*. Time points (t11, t12, t21, and t22) when the sensors S (1*x* and 2*x*) change in the state are indicated on the time axis in FIG. 4(*b*). In the specific example of FIG. 4(*b*), a case in which the sensor Sx1 is brought to an ON state at the time point t11 and the sensor Sx1 is brought to an OFF state at the time point t12 is assumed. Furthermore, a case in which the sensor Sx2 is brought to an ON state at the time point t21 and the sensor Sx2 is brought to an OFF state at the time point t22 is assumed.

In the present embodiment, the length of the transport path P from the sensor S1 to the sensor S2 is shorter than the width (the length in the transport path direction) of a banknote. Therefore, as illustrated in FIG. 4(*b*), when the sensor S1 has changed to an ON state, the sensor S2 changes to the ON state before the sensor S1 changes to the OFF state. However, the length on the transport path P from the sensor S1 to the sensor S2 can be appropriately changed.

As described above, when the states of the sensors S change, the relay device 100 generates the difference information D. For example, in the specific example of FIG. 4(*b*), the difference information D is generated at the time point t11, the time point t21, the time point t12, and the time point t22. The difference information D includes the event information E that identifies sensors S having changed in the state.

FIG. 4(*c*) is an explanatory diagram of a specific example of the event information E(1 to 8). The event information E included in the difference information D is provided with respect to each combination of one of the sensors S having changed in the state, and the manner of the change (OFF to ON, ON to OFF).

For example, when the sensor S1*x* of the receiving unit 5*x* has changed to an ON state in the specific example of FIG. 4(*a*) described above, the difference information D including the event information E1 is generated. When the sensor S2*x* of the receiving unit 5*x* has changed to an ON state, the difference information D including the event information E2 is generated. When the sensor S1*x* of the receiving unit 5*x* has changed to an OFF state, the difference information D including the event information E3 is generated. When the sensor S2*x* of the receiving unit 5*x* has changed to an OFF state, the difference information D including the event information E4 is generated.

Similarly, when the sensor Sly of the receiving unit 5*y* has changed to an ON state, the difference information D including the event information E5 is generated. When the sensor S2*y* of the receiving unit 5*y* has changed to an ON state, the difference information D including the event information E6 is generated. When the sensor Sly of the receiving unit 5*x* has changed to an OFF state, the difference information D including the event information E7 is generated. When the sensor S2*y* of the receiving unit 5*x* has changed to an OFF state, the difference information D including the event information E8 is generated.

For example, in the specific example of FIG. 4(*b*) described above, the difference information D including the event information E1 is generated at the time t11 (the sensor S1*x* is ON). The difference information D including the event information E2 is generated at the time t21 (the sensor S2*x* is ON), the difference information D including the event information E3 is generated at the time t12 (the sensor S1*x* is OFF), and the difference information D including the event information E4 is generated at the time t22 (the sensor S2*x* is OFF).

The type of the sensor S having changed in the state and the manner of the change can be identified by the difference information D including the above event information E(1 to 8). However, the configuration of the event information E is not limited to that in the above example. While both the event information E(1, 2, 5, and 6) in the cases where the state of a sensor S has become an ON state and the event information E(3, 4, 7, and 8) in the cases where the state has become an OFF state are provided, a configuration in which only either of the event information E is provided may be used, for example.

FIGS. 5(*a*), 5(*b*), 5(*c*-1), and 5(*c*-2) are explanatory diagrams of a specific example before generation of the difference information D.

FIG. 5(*a*) is an explanatory diagram of the number C of cycles and the value of the reference timer T included in the difference information D. The time points (t11, t12, t21, and t22) when the states of the sensors S have respectively changed are indicated on the time axis in FIG. 5(*a*). The number C of cycles C and the value of the reference timer T at each of the time points are also indicated in FIG. 5(*a*).

As described above, the reference time is set in the management device 200. In the specific example of FIG. 5(*a*), a case in which the reference time is set at a time point t0 is assumed. As illustrated in FIG. 5(*a*), the number C of cycles is a value "0" immediately after the reference time is set. Thereafter, a value "1" is added to the number C of cycles each time the identification command X is received. For example, a case in which the identification command X is received at a time point tx is assumed in the specific example of FIG. 5(*a*). In this case, the number C of cycles is incremented from a value "N−1" (N is a positive integer) to a value "N" at the time point tx.

As illustrated in FIG. 5(*a*), the reference timer T has a value "0" immediately after the reference time is set. Thereafter, a value "1" is added to the reference timer T every 1 ms. The reference timer T is initialized when the identification command X is received. Therefore, in the specific example of FIG. 5(*a*), the reference timer T is initialized at the time point tx. As described above, the identification command X is transmitted about every 25 s. Therefore, the reference timer T is incremented to a value "25000" immediately before initialization, as illustrated in FIG. 5(*a*).

FIG. 5(*a*) assumes a case in which the sensor Sx1 is brought to an ON state at the time point t11, the sensor Sx1 is brought to an OFF state at the time point t12, the sensor Sx2 is brought to an ON state at the time point t21, and the sensor Sx2 is brought to an OFF state at the time point t22 similarly to the specific example of FIG. 4(*b*) described above. A case in which the reference timer T has a value "n1" at the time point t11, the reference timer T has a value "n2" at the time point t21, the reference timer T has a value "n3" at the time point t12, and the reference timer T has a value "n4" at the time point t22 is assumed.

FIG. 5(*b*) is an explanatory diagram of an elapsed time from the reference time at each of the time points t in FIG. 5(*a*) described above. While explained in detail later, the elapsed time from the reference time is calculated from the difference information D. An actual time at a time point when the difference information D is generated (a time point when the state of one of the sensors has changed) is obtained by adding the elapsed time to the reference time. The event occurring at each of the time points t, the values of the reference timer T and the number C of cycles at each time point, and the generated difference information D are illustrated in FIG. 5(*b*) in addition to the elapsed time at each time point t.

As described above, the number C of cycles and the reference timer T have the value "0" at the time point t0 when the reference time is set. In this case, the elapsed time is "0" (ms) as illustrated in FIG. 5(*b*). The reference timer T has the value "0" and the number C of cycles has the value "N" at the time point tx when the identification command X is received. At the time point tx, the identification command X has been received by the relay device 100 N times from the start of the reference time. Since the identification command X is transmitted about every 25 s, the elapsed time at the time point tx is "25000×N" (ms).

As illustrated in FIG. 5(*b*), the reference timer T has a value "n1" and the number C of cycles has a value "N" at the time point t11 when the sensor S1*x* has changed to an ON state. The time point t11 is a time point when about "n1" (ms) has elapsed from a time point of reception of the Nth identification command X (from the time point tx). Therefore, the elapsed time at the time point t11 is "(25000×N)+(n1)" (ms). Difference information D1 is generated at the time point t11.

As is understood from the above explanations, the elapsed time at each time point is obtained from the number C of cycles and the value of the reference timer T at that time point (elapsed time=(25000×number C of cycles)+(reference timer T)). For example, the elapsed time at the time point t21 is "(25000×N)+(n2)" (ms), the elapsed time at the time point t12 is "(25000×N)+(n3)" (ms), and the elapsed time at the time point t22 is "(25000×N)+(n4)" (ms). Difference information D2 is generated at the time point t21, difference information D3 is generated at the time point t12, and difference information D4 is generated at the time point t22.

FIG. 5(*c*-1) is an explanatory diagram of each information constituting the difference information D. As described above, the difference information D includes the event information E that identifies an occurred event (a sensor that has detected a banknote, and the manner of the state change of the sensor), the value of the number C of cycles at the occurrence time of the event, and the value of the reference timer T at the occurrence time of the event. The data length of the difference information D can be appropriately set. A specific example of the data length of the difference information D will be explained in a modification described later.

FIG. 5(*c*-2) is an explanatory diagram of a specific example of the difference information D. In the specific example of FIG. 5(*c*-2), the difference information D(1 to 4) generated in the specific example of FIG. 4(*b*) (FIG. 4(*a*)) described above are illustrated. For example, the reference timer T has a value "n1" and the number C of cycles is "N" at the time point t11 where the sensor S1*x* is brought to an ON state. At this time point t11, the difference information D1 indicating that "number C of cycles=N, event information E=E1, and reference timer T=n1" is generated.

Sensors S having changed in the state, and the manner of the changes of the sensors S are identified from the event information E of the above difference information D. The elapsed time from the reference time is calculated from the number C of cycles and the reference timer T in the difference information D. Therefore, the history information J described above can be generated from the difference information D.

In the specific example of the history information J illustrated in FIG. 3(*b*) described above, whether the sensor S1 having changed in the state is the sensor S1*x* or the sensor Sly (which of the receiving units 5 includes the sensor S1 having changed in the state) cannot be distinguished. Furthermore, whether the sensor S2 having changed in the state is the sensor S2*x* or the sensor S2*y* cannot be distinguished. However, a configuration in which the history information J that can distinguish whether the sensor S1 having changed in the state is the sensor S1*x* or the sensor Sly, and that can distinguish whether the sensor S2 having changed in the state is the sensor S2*x* or the sensor S2*y* is generated may be applied. That is, the history information J may be configured to include information that identifies a specific event (the state change of a relevant sensor S), the time when this event has occurred, and the sensor having changed in the state.

Since the reference timer T is initialized at the predetermined time intervals, a shorter data length than that of the time counter described above suffices. Therefore, the configuration of the present embodiment has an advantage that the amount of data for generating the history information J can be reduced.

Figure 6A:
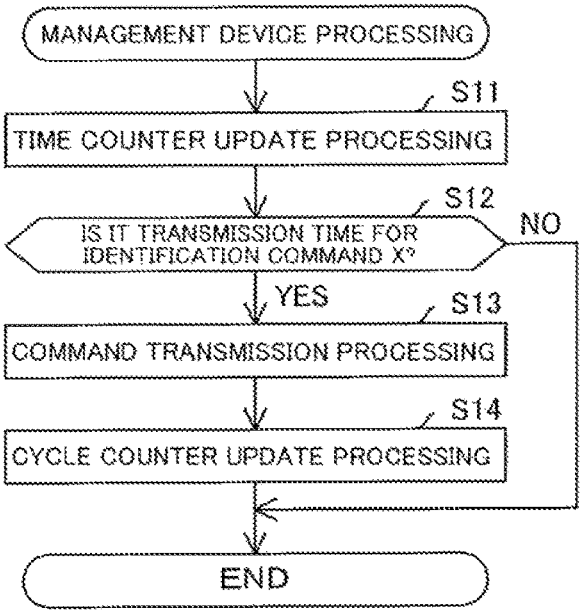
FIG. 6 are flowcharts for explaining respective processing in the information processing system.
Figure 6B:
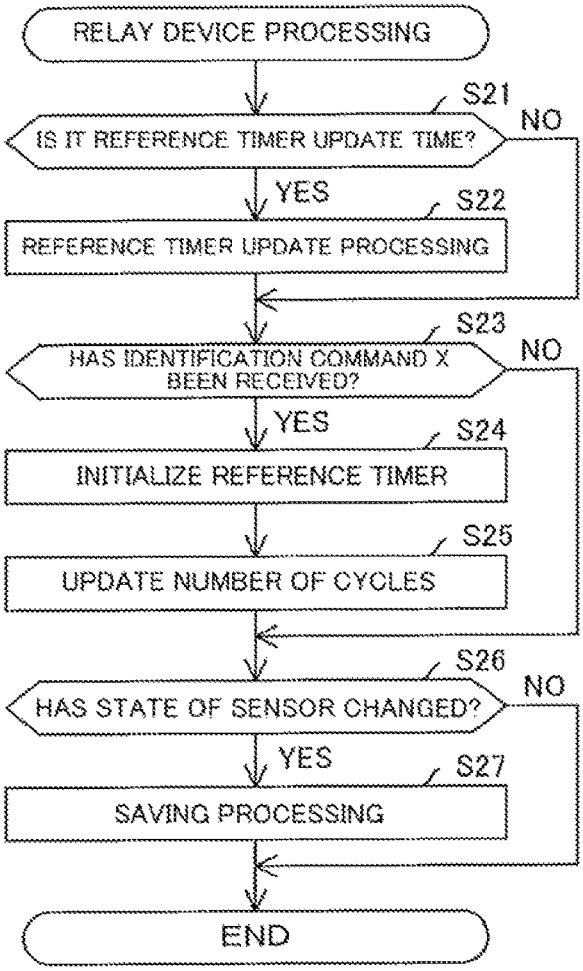

FIG. 6(*a*) is a flowchart of management device processing performed by the management device 200. The management device 200 performs management device processing at predetermined time intervals (for example, every 10 μs).

When the management device processing is started, the management device 200 performs time counter update processing (S11). In the time counter update processing, the time counter is incremented. After performing the time counter update processing, the management device 200 determines whether it is at a transmission time for the identification command X (S12). Specifically, at Step S12, the management device 200 determines whether the time length from last transmission of the identification command X (from when command transmission processing described later is last performed) has reached 25 s.

When determining that it is at a transmission time for the identification command X (YES at S12), the management device 200 performs command transmission processing (S13). In the command transmission processing, the identification command X is transmitted to the relay device 100. After performing the command transmission processing, the management device 200 performs cycle counter update processing (S14). In the cycle counter update processing, a value "1" is added to the cycle counter.

When determining that it is not at a transmission time for the identification command at Step S12 described above (NO at S12), the management device 200 ends the management device processing without performing the command transmission processing and the cycle counter update processing.

FIG. 6(*b*) is a flowchart of relay device processing performed by the relay device 100. When the relay device processing is started, the relay device 100 determines whether it is at an update time for the reference timer T (S21). Specifically, the relay device 100 determines whether the time length from last update of the reference timer T (from when reference timer update processing described later is last performed) has reached 1 ms.

When determining that it is at an update time for the reference timer T (YES at S21), the relay device 100 performs reference timer update processing (S22). In the reference timer update processing, a value "1" is added to the reference timer T. After performing the reference timer update processing, the relay device 100 causes the processing to proceed to Step S23. On the other hand, when determining that it is not at an update time for the reference timer T (NO at S21), the relay device 100 causes the processing to proceed to Step S23 without performing the reference timer update processing.

At Step S23, the relay device 100 determines whether the identification command X has been received. When determining that the identification command X has been received (YES at S23), the relay device 100 initializes the reference timer T (S24), updates the number C of cycles (S25), and causes the processing to proceed to Step S26. On the other hand, when determining that the identification command X has not been received (NO at S23), the relay device 100 omits Step S24 and Step S25 described above and causes the processing to proceed to Step S26.

At Step S26, the relay device 100 determines whether the state (an ON state or an OFF state) of the sensor S1 or the sensor S2 has changed. When determining that the state of the sensor S has changed (YES at S26), the relay device 100 performs saving processing (S27).

In the saving processing, the difference information D described above is generated and is saved in the storage unit 102. Specifically, the relay device 100 analyzes the sensor S having changed in the state among the sensors S and the manner of the state change, and determines the event information E (see FIG. 4(*c*) described above) according to the analysis result in the saving processing. The relay device 100 also acquires the current values of the number C of cycles and the reference timer T stored in the storage unit 102, and generates the difference information D including the event information E described above and the current values of the number C of cycles and the reference timer T.

After performing the saving processing, the relay device 100 ends the relay device processing. When determining that the states of the sensors S have not changed at Step S26 described above (NO at S26), the relay device 100 omits the saving processing and ends the relay device processing.

Second Embodiment

Other embodiments of the present invention will be explained below. In each of the embodiments exemplified below, as for elements having actions and functions equivalent to those of the first embodiment, reference signs referred to in the explanations of the first embodiment are used and detailed explanations of such elements are appropriately omitted.

In the first embodiment described above, a configuration that can detect a banknote moving along the transport path Pb in each of the receiving units 5 in the transport paths P (Pa and Pb) is adopted (see FIG. 2 described above). In the second embodiment, a configuration that can detect that a banknote has moved along the transport path Pa of the transport unit 8 in addition to the transport path Pb of each of the receiving units 5 is used.

Figure 7A:
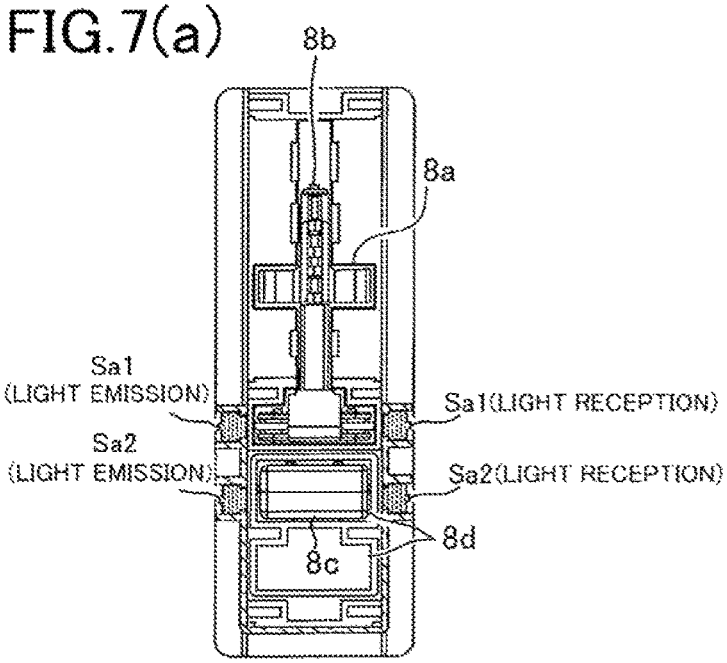
FIG. 7 are explanatory diagrams of respective sensors in a second embodiment.
Figure 7B:
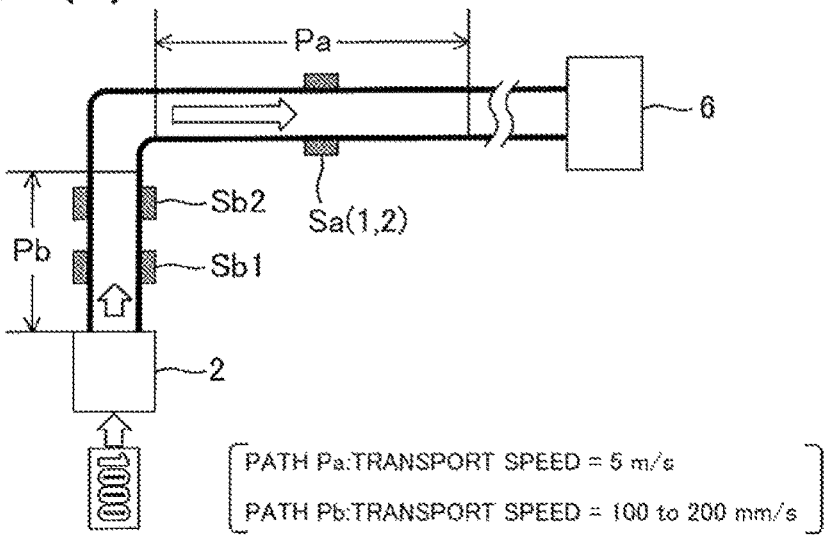
Figure 7C:
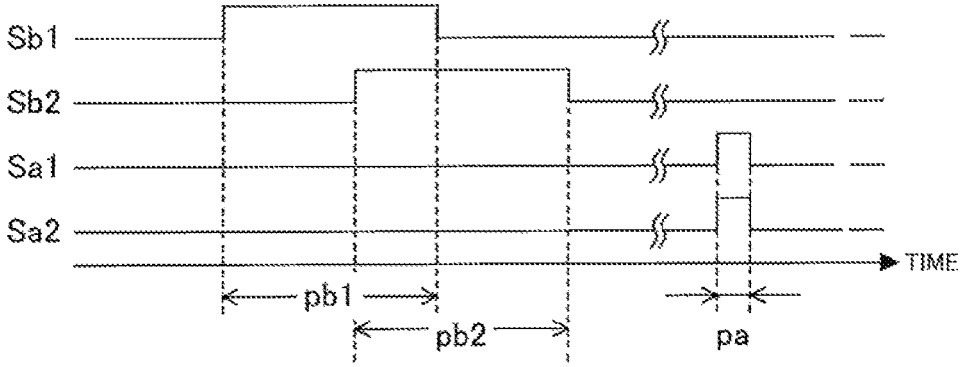

FIG. 7(*a*) is an explanatory diagram of sensors Sa (Sa1 and Sa2) for detecting that a banknote has moved along the transport path Pa of the transport unit 8. FIG. 7(*a*) illustrates a section of the transport unit 8 cut in a direction orthogonal to the longitudinal direction. As described above, the transport unit 8 includes the transport body 8*b* and the moving body 8*c*. The moving body 8*c* moves inside the air blowing tube 8*d* due to the air flow generated by the blower device 7. The transport body 8*b* moves inside the transport tube 8*a* in a state holding banknotes along with movement of the moving body 8*c*.

As illustrated in FIG. 7(*a*), the sensor Sa1 and the sensor Sa2 are provided on the transport unit 8. The sensor Sa1 is provided to be capable of detecting the transport body 8*b* moving in the transport unit 8 (the transport tube 8*a*). Specifically, the sensor Sa1 is configured to include a light emitting element and a light receiving element. The light emitting element is provided on one of sidewalls of the transport tube 8*a* and the light receiving element is provided on the other side wall of the transport tube 8*a*.

In a period in which no banknote moves along the transport path Pa (a period in which the transport body 8*b* does not move in the transport tube 8*a*), detection light emitted from the light emitting element of the sensor Sa1 is received by the light receiving element. On the other hand, when the transport body 8*b* is positioned in the detection area of the sensor Sa1 on the transport path Pa, the detection light emitted from the light emitting element of the sensor Sa1 is blocked by the transport body 8*b* and does not enter the light receiving element. Hereinafter, a state in which the detection light does not enter the light receiving element of the sensor Sa1 is referred to as an ON state of the sensor Sa1 for sake of explanations. A state in which the detection light enters the light receiving element of the sensor Sa1 is referred to as an OFF state of the sensor Sa1.

As described above, a banknote moves integrally with the transport body 8*b* along the transport path Pa (inside the transport tube 8*a*). Therefore, when the transport body 8*b* is detected on the transport path Pa, the fact that the banknote has moved along the transport path Pa is substantially detected. A configuration including sensors that directly detect a banknote on the transport path Pa (for example, the sensors S in the receiving units 5, see FIG. 2(*b*) described above) may be applied.

However, a banknote is sometimes difficult to be directly detected depending on the type (shape) of the banknote moving along the transport path Pa. Therefore, inconvenience that a banknote is not properly detected may arise in the configuration including the sensors that directly detect a banknote on the transport path Pa. The second embodiment described above has an advantage that this inconvenience is suppressed.

The sensor Sa2 is provided to be capable of detecting the moving body 8*c* that moves in the transport unit 8 (the air blowing tube 8*d*). Specifically, the sensor Sa2 is configured to include a light emitting element and a light receiving element. The light emitting element is provided on one of sidewalls of the air blowing tube 8*d* and the light receiving element is provided on the other sidewall of the air blowing tube 8*d*.

In a period in which no banknote moves along the transport path Pa (a period in which the moving body 8*c* does not move in the air blowing tube 8*d*), detection light emitted from the light emitting element of the sensor Sa2 is received by the light receiving element. On the other hand, when there is the moving body 8*c* in the detection area of the sensor Sa2, the detection light emitted from the light emitting element of the sensor Sa2 is blocked by the moving body 8*c* and does not enter the light receiving element. Hereinafter, for sake of explanations, a state in which the detection light does not enter the light receiving element of the sensor Sa2 is referred to as an ON state of the sensor Sa2. A state in which the detection light enters the light receiving element of the sensor Sa2 is referred to as an OFF state of the sensor Sa2.

The sensor Sa1 that detects the transport body 8*b* described above is provided substantially immediately above the sensor Sa2 that detects the moving body 8*c*. With this configuration, when the transport body 8*b* (banknotes) moves along the transport path Pa with the moving body 8*c*, the sensor Sa1 and the sensor Sa2 change to an ON state at a substantially same time (see FIG. 7(*c*) described later). However, the locations where the sensor Sa1 and the sensor Sa2 are provided may be appropriately changed.

FIG. 7(*b*) is an explanatory diagram of details of the transport paths P (Pa and Pb), and the sensors S (Sa and Sb) that detect a banknote moving along the transport paths P in the second embodiment. While a specific example in which one receiving unit 5 is provided is illustrated in FIG. 7(*b*), a configuration in which a plurality of the receiving units 5 are provided (for example, that in the first embodiment described above) may be adopted.

The receiving unit 5 includes the sensor S1 and the sensor S2 that detect a banknote on the transport path P (Pb) similarly to the first embodiment described above (see FIG. 2(*b*) described above). Hereinafter, the sensor S1 of the receiving unit 5 is referred to as "sensor Sb1" and the sensor S2 is referred to as "sensor Sb2" for sake of explanations.

Banknotes are transported by drive rollers (52 and 53 in FIG. 2(*b*)) along the transport path Pb of the receiving unit 5 in the second embodiment, similarly to the first embodiment. Meanwhile, banknotes are transported by an air flow on the transport path Pa of the transport unit 8. In this configuration, the transport speed of banknotes differs between the transport path Pa and the transport path Pb. In the second embodiment, the transport speed of banknotes on the transport path Pa is about 5 m/s and the transport speed of banknotes on the transport path Pb is about 100 to 200 mm/s as illustrated in FIG. 7(*b*). That is, banknotes are transported on the transport path Pa at a higher speed than on the transport path Pb.

As illustrated in FIG. 7(*b*), when a banknote input to one of the gaming devices 2 is transported to the safe 6, the banknote is detected by the sensor Sb1 on the transport path Pb, is detected by the sensor Sb2 on the transport path Pb, and is substantially simultaneously detected by the sensor Sa1 and the sensor Sa2 on the transport path Pa.

FIG. 7(*c*) is an explanatory diagram of a specific example of state changes of the sensors S. Periods (pb1, pb2, and pa) in which the sensors S are respectively in an ON state are indicated on the time axis in FIG. 7(*c*). In the second embodiment, when a banknote moves along the transport path Pb, the sensor Sb1 is in an ON state in the period pb1, and the sensor Sb2 is in an ON state in the period pb2. When the banknote thereafter moves along the transport path Pa, the sensor Sa1 and the sensor Sa2 are in an ON state in the period pa.

As described above, banknotes are transported on the transport path Pa at a higher speed than on the transport path Pb. Therefore, the time length of the period pa in which the sensors Sa(1 and 2) are in an ON state on the transport path Pa is shorter than the time length of the periods pb(1 and 2) in which the sensors Sb are in an ON state on the transport path Pb as illustrated in FIG. 7(*c*).

FIGS. 8(*a*) to 8(*c*) are explanatory diagrams of a configuration for generating the difference information D. The difference information D in the second embodiment is configured to include the event information E, and the values of the reference timer T and the number C of cycles similarly to the first embodiment described above.

However, two reference timers T (Ta and Tb) and two numbers C (Ca and Cb) of cycles are provided in the relay device 100 of the second embodiment, which will be described in detail later. The difference information D is generated using the reference timer T and the number C of cycles differing according to the transport paths P (Pa and Pb) on which a banknote is detected.

FIG. 8(*a*) is an explanatory diagram of event information E(11 to 18) of the second embodiment. The event information E of the second embodiment identifies a sensor S (a1, a2, b1, or b2) having changed in the state, and the manner (OFF to ON, ON to OFF) of the change similarly to the event information E of the first embodiment (see FIG. 4(*c*) described above).

FIG. 8(*b*) is an explanatory diagram of the reference timers T (Ta and Tb) and the numbers C (Ca and Cb) of cycles provided in the relay device 100 (the storage unit 102) of the second embodiment. As illustrated in FIG. 8(*b*), the reference timers T of the second embodiment are configured to include a reference timer Ta and a reference timer Tb. The update time interval differs between the reference timer Ta and the reference timer Tb.

Specifically, the reference timer Ta is incremented by a value "1" about every 10 μs. The relay device 100 generates the difference information D including the current value of the reference timer Ta when the state of each of the sensors Sa (Sa1 and Sa2) on the transport path Pa among the sensors S has changed. In the second embodiment, the difference information D generated when the state of each of the sensors Sa on the transport path Pa has changed is referred to as "difference information Da" for sake of explanations.

Meanwhile, the reference timer Tb is incremented by a value "1" about every 1 ms (similarly to the reference timer T in the first embodiment). As is understood from the above explanations, the reference timer Ta is updated at shorter time intervals than those of the reference timer Tb. The relay device 100 generates the difference information D including the current value of the reference timer Tb when the state of each of the sensors Sb (Sb1 and Sb2) on the transport path Pb among the sensors S has changed. In the second embodiment, the difference information D generated when the state of each of the sensors Sb on the transport path Pb has changed is referred to as "difference information Db" for sake of explanations.

As illustrated in FIG. 8(*b*), the reference timer Ta is initialized about every 5 s. The relay device 100 of the second embodiment stores therein the number Ca of cycles indicating the number of times of initialization of the reference timer Ta. The reference timer Tb is initialized about every 25 s (similarly to the reference timer T of the first embodiment). The relay device 100 of the second embodiment stores therein the number Cb of cycles indicating the number of times of initialization of the reference timer Tb.

A configuration in which the reference timer Ta and the reference timer Tb are initialized at same time intervals is assumed in a configuration in which the reference timer Ta is incremented at shorter time intervals than those of the reference timer Tb. It is presumed that the number of times of increment before a carry is produced is same in the reference timer Ta and the reference timer Tb (data lengths of the reference timer Ta and the reference timer Tb are same) in this configuration. With this configuration, inconvenience that a carry is more likely to be produced in the reference timer Ta is assumed. As described above, since the reference timer Ta is initialized at shorter time intervals than those of the reference timer Tb in the configuration of the second embodiment, there is an advantage of suppressing the inconvenience described above.

FIG. 8(*c*) is an explanatory diagram of the difference information D (Da and Db) in the second embodiment. As described above, the difference information Da is generated when the sensor Sa detects the transport body 8*b* or the moving body 8*c* (when a banknote moves along the transport path Pa), and the difference information Db is generated when the sensor Sb detects a banknote (when the banknote moves along the transport path Pb) in the second embodiment.

As illustrated in FIG. 8(*c*), the difference information Da is configured to include the number Ca of cycles, the event information E (E11 to E14), and the value of the reference timer Ta. For example, when the sensor Sa1 is brought to an ON state, the relay device 100 generates the difference information Da including the current values of the number Ca of cycles and the reference timer Ta, and the event information E11 (see FIG. 8(*a*) described above) and saves the generated difference information Da.

As illustrated in FIG. 8(*c*), the difference information Db is configured to include the number Cb of cycles, the event information E (E15 to E18), and the value of the reference timer Tb. For example, when the sensor Sb1 is brought to an ON state, the relay device 100 generates the difference information Db including the current values of the number Cb of cycles and the reference timer Tb, and the event information E15 (see FIG. 8(*a*) described above) and saves the generated difference information Db.

In the second embodiment, the reference time is set similarly to the first embodiment described above. The elapsed time (ms) from the reference time is calculated, for example, by a mathematical expression "5000×(current value of number Ca of cycles)+(current value of reference timer Ta)×(1/100)". That is, the elapsed time can be calculated from the difference information Da. Similarly, the elapsed time (ms) from the reference time is calculated, for example, by a mathematical expression "25000×(current value of number Cb of cycles)+(current value of reference timer Tb)". That is, the elapsed time can be calculated from the difference information Db.

As is understood from the above explanations, both the time when a banknote is detected on the transport path Pa and the time when a banknote is detected on the transport path Pb are identified by the difference information D (Da and Db) of the second embodiment. The management device 200 of the second embodiment acquires the difference information D from the relay device 100 at predetermined moments and generates the history information J that identifies both the time when a banknote is detected on the transport path Pa and the time when a banknote is detected on the transport path Pb.

While the difference information D is generated using the different reference timers T in the case in which a banknote moves along the transport path Pa and the case in which a banknote moves along the transport path Pb in the second embodiment, a configuration in which a common reference timer T is used in these cases may be applied. However, if the update interval of the reference timer T is too short relative to the transport speed of banknotes, the data length of the reference timer T becomes undesirably long. If the update interval of the reference timer T is too long relative to the transport speed of banknotes, inconvenience arises that an error between an actual time when a banknote is detected and a detection time calculated from the difference information D becomes large.

In view of the circumstances described above, the configuration in which the reference timers T (Ta and Tb) are respectively provided for the transport paths P (Pa and Pb) that are different in the transport speed of banknotes is adopted in the second embodiment. This configuration has an advantage that the reference timer T having an appropriate update interval can be provided depending on the transport speed of banknotes as compared to, for example, a configuration in which a common reference timer T is used for any transport paths P where a banknote is detected.

Third Embodiment

Figure 9A:
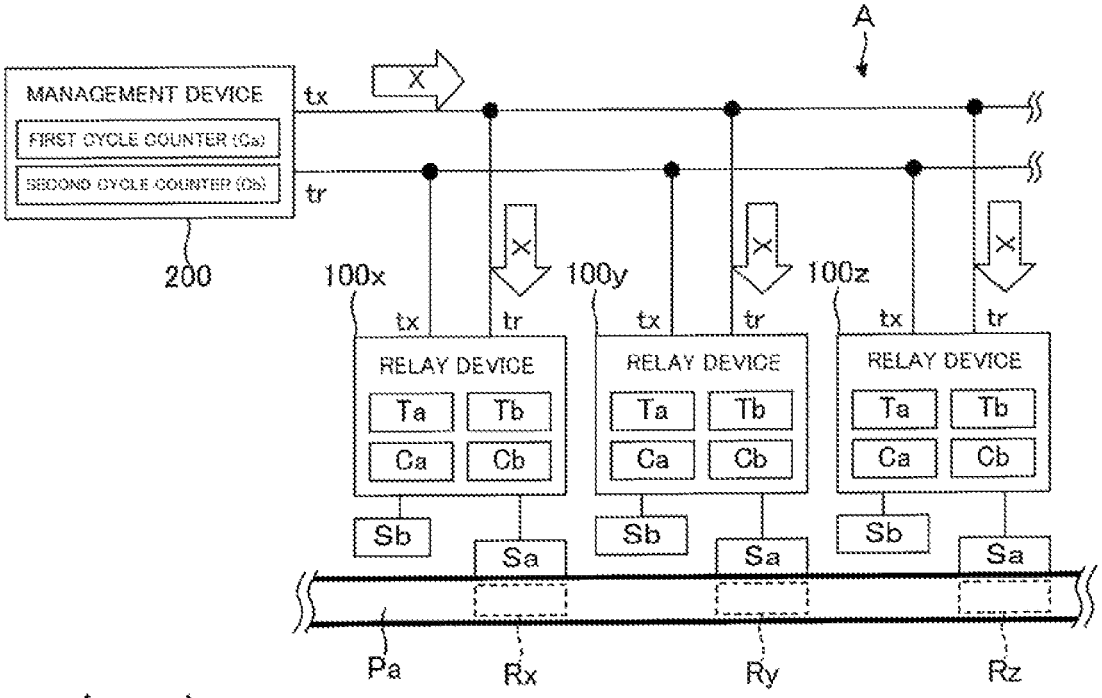
FIG. 9 are explanatory diagrams of an information processing system in a third embodiment.

FIG. 9(*a*) is an explanatory diagram of the information processing system A according to a third embodiment. As illustrated in FIG. 9(*a*), the information processing system A according to the third embodiment is configured to include the management device 200, and a plurality of relay devices 100(*x, y*, and *z*). While the information processing system A including three relay devices 100 is illustrated in a specific example of FIG. 9(*a*), the number of the relay devices 100 is not limited to three.

The receiving units 5 are connected to each of the relay devices 100, and a detection signal (an ON signal or an OFF signal) from the sensor Sb of each of the receiving units 5 is input thereto. Specifically, a plurality of (for example, four) receiving units 5 are connected to each of the relay devices 100 and the detection signal from the sensor Sb of each of the receiving units 5 is input thereto. However, one sensor Sb among the sensors Sb connected to the receiving units 5 is selectively illustrated in FIG. 9(*a*).

A detection signal (an ON signal or an OFF signal) from each of the sensors Sa of the transport unit 8 is input to each of the relay devices 100. Specifically, as illustrated in FIG. 9(*a*), a plurality of (three) sensors Sa are provided on the transport path Pa of the third embodiment, and the detection signals from the sensors Sa are input to different ones of the relay devices 100, respectively. Regions R(x, y, and z) of the transport path Pa where a banknote is detected by the sensors Sa differ according to the sensors Sa, respectively.

Specifically, the sensor Sa connected to the relay device 100*x* is brought to an ON state when a banknote (the transport body 8*b*) is positioned in the region Rx of the transport path Pa as illustrated in FIG. 9(*a*). Similarly, the sensor Sa connected to the relay device 100*y* is brought to an ON state when a banknote is positioned in the region Ry of the transport path Pa, and the sensor Sa connected to the relay device 100*z* is brought to an ON state when a banknote is positioned in the region Rz of the transport path Pa.

The relay devices 100 are communicably connected to the management device 200. Specifically, each of the relay devices 100 includes a dedicated output line tx for transmitting a response to the management device 200, and a dedicated input line tr for receiving a command from the management device 200 as illustrated in FIG. 9(*a*). The management device 200 includes a dedicated output line tx for transmitting a command for the relay devices 100, and a dedicated input line tr for receiving responses from the relay devices 100.

As is understood from the above explanations, each of the relay devices 100 and the management device 200 are connected by full-duplex communication. However, the connection method of each of the relay devices 100 and the management device 200 is not limited to the full-duplex communication. For example, a configuration in which each of the relay devices 100 and the management device 200 are connected by half-duplex communication may be used.

As illustrated in FIG. 9(*a*), each of the relay devices 100 includes the reference timer Ta and the reference timer Tb similarly to the second embodiment described above. In the third embodiment, the difference information Da is generated using the reference timer Ta and the difference information Db is generated using the reference timer Tb similarly to the second embodiment described above.

As illustrated in FIG. 9(*a*), the management device 200 transmits the identification command X to the relay devices 100. Specifically, the management device 200 transmits the identification command X to the relay devices 100 at the same time about every 5 s. Each of the relay devices 100 includes a counter (a counting unit) that counts the number of times of reception of the identification command X.

The management device 200 includes a first cycle counter and a second cycle counter. The first cycle counter is incremented by a value "1" each time the identification command X is transmitted (about every 5 s). The second cycle counter is incremented by a value "1" each time the identification command X is transmitted five times (about every 25 s).

FIGS. 9(*b*-1) and 9(*b*-2) are explanatory diagrams of parts (data parts) of each information included in the identification command X. As illustrated in FIGS. 9(*b*-1) and 9(*b*-2), the identification command X is configured to include a data part dp1 and a data part dp2.

FIG. 9(*b*-1) is an explanatory diagram of the identification command X (hereinafter, also "identification command X1") transmitted for the (5×m)th time (m is a positive integer). As illustrated in FIG. 9(*b*-1), the data part dp1 of the identification command X1 indicates the current value of the first cycle counter. The data part dp2 of the identification command X1 indicates the current value of the second cycle counter.

When receiving the identification command X1, each of the relay devices 100 overwrites the number Ca of cycles with the data part dp1 of the received identification command X1 (adds a value "1"). When overwriting the number Ca of cycles, each of the relay devices 100 initializes the reference timer Ta. Similarly, when receiving the identification command X1, each of the relay devices 100 overwrites the number Cb of cycles with the value of the data part dp2 of the received identification command X1. When overwriting the number Cb of cycles, each of the relay devices 100 initializes the reference timer Tb.

FIG. 9(*b*-2) is an explanatory diagram of the identification command X (hereinafter, also "identification command X2") transmitted for times (the first to fourth times, the sixth to ninth times, . . . ) other than the (5×m)th time. As illustrated in FIG. 9(*b*-2), the data part dp1 of the identification command X2 indicates the current value of the first cycle counter. The data part dp2 of the identification command X2 indicates a value "0".

When receiving the identification command X2, each of the relay devices 100 overwrites the number Ca of cycles with the data part dp1 of the received identification command X1 similarly to the case of receiving the identification command X2 described above. When the identification command X2 is received, the reference timer Ta is initialized. Meanwhile, when receiving the identification command X2, each of the relay devices 100 does not overwrite the number Cb of cycles. Furthermore, the reference timer Tb is not initialized.

With this configuration, each of the relay devices 100 initializes the reference timer Ta each time the identification command X is received (about every 5 s), and initializes the reference timer Tb each time the identification command X is received five times (about every 25 s), similarly to the second embodiment described above.

In the configuration described above, the number Ca of cycles stored in each of the relay devices 100 is the current value of the first cycle counter of the management device 200. That is, the numbers Ca of cycles in the relay devices 100 are synchronized. Similarly, the number Cb of cycles stored in each of the relay devices 100 is the current value of the second cycle counter of the management device 200. That is, the numbers Cb of cycles in the relay devices 100 are synchronized.

The management device 200 of the third embodiment stores therein the reference time similarly to the embodiments described above. The difference information D (Da and Db) generated by each of the relay devices 100 includes values of the reference timers T (Ta and Tb) and the numbers C (Ca and Cb) of cycles, respectively. From this difference information D, the elapsed time from the reference time is calculated similarly to the embodiments described above.

In a configuration in which the reference timers T and the numbers C of cycles in the relay devices 100 are not synchronized, the reference time needs to be set for each of the relay devices 100. In this configuration, inconvenience that many reference times need to be set in the management device 200 arises when the number of the relay devices 100 is large.

In the third embodiment, the identification command X is transmitted to the relay devices 100 at the same time and the reference timers T and the numbers C of cycles in the relay devices 100 are synchronized. Therefore, the reference time does not need to be set for each of the relay devices 100 and there is an advantage that the inconvenience described above is suppressed.

In the third embodiment, same effects as those in the first embodiment and the second embodiment described above are achieved. Furthermore, since the identification command X is transmitted to the relay devices 100 at the same time and the reference timers T and the numbers C of cycles in the relay devices 100 are synchronized in the third embodiment, there is an advantage that a plurality of reference times do not need to be set.

<Modification>

The foregoing respective embodiments may be variously modified. Specific modes of modifications are exemplified below. Two or more of the modes arbitrarily selected from the following exemplifications may be appropriately combined with each other.

In the embodiments described above, the configuration (data length or the like) of the difference information D can be appropriately changed. For example, 32 bits can be used as the data length of the difference information D. This difference information D is constituted of, for example, 8 bits of the number C of cycles, 4 bits of the event information E, and 20 bits of the value of the reference timer T.

In a case in which the above difference information D is used, for example, the reference timer Ta of the second embodiment is incremented by a value "1" every 10 μs and therefore does not need to be initialized for about 10.48576 (=(the 20th power of 2)/100000) s. As described above, the reference timer Ta is initialized about every 5 s (≤10.48576). Therefore, the reference timer Ta is not incremented to a value equal to or more than "500000" in principle.

A part of the identification command X that is periodically transmitted from the management device 200 is not received by the relay devices 100 in some cases, for example, due to influences of noise. In these cases, inconvenience arises that the value of the reference timer Ta reaches "1048576" to produce a carry, and the difference information D that enables calculation of an accurate elapsed time is not generated.

In view of the circumstances described above, the management device 200 of the modification transmits the identification command X to the relay device 100 at time intervals sufficiently shorter than the length of the time that elapses before the reference timer T produces a carry. Specifically, the management device 200 transmits the identification command X about every 5 s as described above.

If one identification command X is not received by the relay device 100, the reference timer Ta is not initialized for about 10 s. Therefore, the reference timer Ta is incremented to a value "1000000". However, since the reference timer Ta of the modification includes 20 bits, no carry is produced even if the relay device 100 fails to receive one identification command X.

Even in the above modification, the reference timer Ta produces a carry when the relay device 100 continuously fails to receive the identification commands X. In view of the above circumstances, a configuration in which the difference information D that enables calculation of an accurate elapsed time can be generated even when the reference timer Ta produces a carry is preferable.

A configuration in which the relay device 100 stores therein the number of carries when the reference timer Ta produces a carry is conceivable as the above configuration. For example, a case in which the number C of cycles in the difference information D is "N", the reference timer Ta is "n", and the number of times when the reference timer Ta produces a carry is "m" is assumed. In this case, the elapsed time is calculated by a mathematical expression "$5000\times N+n\times(1/100)+10485.76\times m$" (ms).

The configuration in which the relay device 100 stores therein the number of carries may be replaced with a configuration in which the identification command X includes the number C of cycles (for example, that in the third embodiment described above), to obtain a difference between the number C of cycles in the identification command X last received, and the number C of cycles in the identification command X received this time. In this configuration, when the difference in the number C of cycles between the identification commands X is a value "1", no identification command X fails to be received in a period from when the identification command X is last received until when the identification command X is received this time. On the other hand, when the difference in the number C of cycles between the identification commands X is a value "m+1", the fact that the identification command X fails to be received m times in a period from when the identification command X is last received until when the identification command X is received this time can be identified. This configuration may be applied to the reference timer Tb that is incremented about every 1 ms and that is initialized about every 25 s, in addition to the reference timer Ta described above.

Alternatively, a configuration in which only the difference information Da out of the difference information Da and the difference information Db is saved in the bank end unit 4 may be adopted. In this configuration, the difference information Da is stored in both the relay device 100 and the bank end unit 4.

<Summary of Action and Effects of Aspects of Embodiment>

<First Aspect>

An information processing device (the relay device 100) according to the present aspect includes: an update unit (103) that updates a reference timer (Ta or Tb) at predetermined time intervals (10 μs and 1 ms); an initializing unit (104) that initializes the reference timer at predetermined time intervals (5 s and 25 s); a storage unit (102) that stores therein the number of times of the initialization; and a saving unit (105) that saves difference information (D) identifying a current value of the reference timer and the number of times of the initialization when a paper sheet moves along a transport path (P). According to the present aspect, the amount of data for generating history information that can identify the time when a paper sheet is detected on the transport path can be reduced.

<Second Aspect>

In the information processing device of the present aspect, the saving unit saves the difference information (Da) including first event information (E11 to E14) when a paper sheet moves along a first transport path (Pa) in the transport path, and saves the difference information (Db) including second event information (E15 to E18) different from the first event information when a paper sheet moves along a second transport path (Pb) in the transport path. In this aspect, the type of a transport path along which a paper sheet moves can be identified based on the difference information.

<Third Aspect>

In the information processing device of the present aspect, the reference timer includes a first reference timer (Ta) and a second reference timer (Tb), the update unit updates the first reference timer at shorter time intervals than those of the second reference timer, and the saving unit saves the difference information including a current value of the first reference timer when a paper sheet moves along the first transport path, and saves the difference information including a current value of the second reference timer when a paper sheet moves along the second transport path. According to this aspect, the difference information can be generated based on the reference timer appropriate for the transport speed of a banknote.

<Fourth Aspect>

In the information processing device of the present aspect, the initialization unit initializes the first reference timer at shorter time intervals than those of the second reference timer. The present aspect suppresses inconvenience that the first reference timer produces a carry even when a configuration in which the first reference timer is updated at shorter time intervals than those of the second reference timer is adopted.

<Fifth Aspect>

An information processing system (A) of the present aspect is an information processing system including a management device (200) and a plurality of relay devices (100*x*, 100*y*, and 100*z*), in which the management device includes a transmitting unit that transmits an identification command (X) at predetermined time intervals, and each of the relay devices includes a receiving unit that receives the identification command, an update unit that updates a reference timer at predetermined time intervals, an initializing unit that initializes the reference timer when the identification command is received, a counting unit that counts the number of times of the initialization, and a saving unit that saves difference information identifying a current value of the reference timer and the number of times of the initialization when a paper sheet moves along a transport path. According to this aspect, the same effect as that of the first aspect described above is achieved.

<Sixth Aspect>

In the information processing system of the present aspect, the transmitting unit can transmit the identification command to the relay devices substantially simultaneously. According to this aspect, the reference timers in the relay devices can be synchronized. The numbers of times of the initialization counted by the counting units in the relay devices can be synchronized.

REFERENCE SIGNS LIST

100 relay device, 101 receiving unit, 102 storage unit, 103 update unit, 104 initializing unit, 105 saving unit, 200 management device, 201 transmitting unit, 202 storage unit, 203 information restoring unit, 204 control unit.

The invention claimed is:

1. An information processing device comprising:

an update unit that updates a reference timer at predetermined time intervals;

an initializing unit that initializes the reference timer at predetermined time intervals;

a storage unit that stores therein number of times of the initialization; and a saving unit that saves difference information identifying a current value of the reference timer and the number of times of the initialization when a paper sheet moves along a transport path.

2. The information processing device according to claim 1, wherein the saving unit saves the difference information including first event information when a paper sheet moves along a first transport path in the transport path, and saves the difference information including second event information different from the first event information when a paper sheet moves along a second transport path in the transport path.

3. The information processing device according to claim 2, wherein the reference timer includes a first reference timer and a second reference timer, the update unit updates the first reference timer at shorter time intervals than those of the second reference timer, and the saving unit saves the difference information including a current value of the first reference timer when a paper sheet moves along the first transport path, and saves the difference information including a current value of the second reference timer when a paper sheet moves along the second transport path.

4. The information processing device according to claim 3, wherein the initialization unit initializes the first reference timer at shorter time intervals than those of the second reference timer.

5. An information processing system comprising a management device and a plurality of relay devices, wherein the management device comprises a transmitting unit that transmits an identification command at predetermined time intervals, and each of the relay devices comprises a receiving unit that receives the identification command, an update unit that updates a reference timer at predetermined time intervals, an initializing unit that initializes the reference timer when the identification command is received, a counting unit that counts number of times of the initialization, and a saving unit that saves difference information identifying a current value of the reference timer and the number of times of the initialization when a paper sheet moves along a transport path.

6. The information processing system according to claim 5, wherein the transmitting unit can transmit the identification command to the relay devices substantially simultaneously.

* * * * *